United States Patent [19]

Suzuki

[11] Patent Number: 4,780,136

[45] Date of Patent: Oct. 25, 1988

[54] METHOD OF INJECTING BURNING RESISTANT FUEL INTO A BLAST FURNACE

[75] Inventor: Tomio Suzuki, Kobe, Japan

[73] Assignee: Kabushiki Kaisha Kobe Seiko Sho, Kobe, Japan

[21] Appl. No.: 31,375

[22] Filed: Mar. 30, 1987

[30] Foreign Application Priority Data

Mar. 28, 1986 [JP] Japan ..... 61-71608
Apr. 10, 1986 [JP] Japan ..... 61-82478

[51] Int. Cl.[4] ..... C21B 5/00; C21B 7/16; F23C 1/12

[52] U.S. Cl. ..... 75/42; 266/197; 75/92; 110/261; 110/347; 431/174; 431/284

[58] Field of Search ..... 75/42, 43, 92; 110/261, 110/347; 431/174, 284; 266/197

[56] References Cited

U.S. PATENT DOCUMENTS

| | | | |
|---|---|---|---|
| 1,535,174 | 4/1925 | McGregor | 75/42 |
| 3,302,596 | 2/1967 | Zinn | 110/261 |
| 4,162,140 | 7/1979 | Reed | 431/284 |
| 4,266,968 | 5/1981 | Daldrup et al. | 75/42 |
| 4,326,700 | 4/1982 | Arp et al. | 431/284 |
| 4,428,727 | 1/1984 | Deussner et al. | 110/261 |
| 4,480,991 | 11/1984 | Füssi | 431/284 |
| 4,490,171 | 12/1984 | Suzuki et al. | 266/182 |
| 4,523,530 | 6/1985 | Kaminaka | 431/284 |
| 4,597,342 | 7/1986 | Green et al. | 110/347 |
| 4,614,159 | 9/1986 | Sugiura et al. | 110/261 |

FOREIGN PATENT DOCUMENTS

| | | | |
|---|---|---|---|
| 0018210 | 2/1981 | Japan | 110/261 |
| 0102005 | 6/1983 | Japan | 110/261 |
| 0071812 | 4/1985 | Japan | 110/261 |
| 4023763 | 4/1986 | Japan . | |

*Primary Examiner*—L. Dewayne Rutledge
*Assistant Examiner*—David W. Schumaker
*Attorney, Agent, or Firm*—Oblon, Fisher Spivak, McClelland & Maier

[57] ABSTRACT

A method of injecting burning resistant fuel into a blast furnace, which includes the steps of supplying a hot blast air having a temperature of at least 810° C. into a blast furnace, injecting the burning resistant fuel into the hot blast air, and injecting a gas fuel into the hot blast air independently of injection of the burning resistant fuel. The gas fuel is supplied to an outer peripheral area of the burning resistant fuel. The injection of the gas fuel is in a proportion of at least 2% of the injection of the burning resistant fuel in terms of calorific value.

13 Claims, 3 Drawing Sheets

METHOD OF INJECTING BURNING RESISTANT FUEL INTO A BLAST FURNACE

BACKGROUND OF THE INVENTION

1. Field of the Invention

The present invention relates to a method of injecting a pulverized fuel into a blast furnace, and more particularly to a method of injecting a pulverized fuel generally regarded as a burning resistant fuel having a low combustibility, from a fuel injection burner to a tuyere of the blast furnace, which method may improve the combustion rate of the burning resistant fuel.

2. Description of the Prior Art

In recent blast furnace operations, injection of a heavy oil as a fuel has been shifted to an all-coke operation, which has proceeded to injection of a fine coal powder. However, pulverized fuel such as fine coal powder or the like (hereinafter referred to generally as "pulverized fuel") has drawbacks in that it has low combustibility as compared with heavy oil, and contains incombustible components such as an ash content. Therefore, various countermeasures against such drawbacks are required in the injecting operation of pulverized fuel.

In the above circumstances, the present applicant has conducted research so as to accomplish an effective method of injecting the pulverized fuel, and has proposed a technique as disclosed in Japanese Patent Publication No. 60-53081 (U.S. Pat. No. 4,490,171), for example. According to this technique, the injection position of the pulverized fuel is located at an optimum distance upstream of a tuyere, so that both the requirements of improvement in the combustion rate of the pulverized fuel and prevention of ash deposition in the blow pipe may be satisfied. This method may prevent such ash deposition on an inner wall of the blow pipe even when the temperature of a hot blast air to be supplied into the blow pipe is increased, thereby meeting both the above-mentioned requirements.

As described in the aforementioned published specification, at page 4, FIG. 5, it is necessary to use a hot blast air having a high temperature of at least 1050° C. for high combustion rate. Accordingly, the operation temperature of a hot blast stove must be increased, which is disadvantageous from the viewpoint of energy savings. Additionally, the life of a refractory formed furnace wall and duct is shortened to reduce maintenance of the equipment.

SUMMARY OF THE INVENTION

It is an object of the present invention to provide a method of injecting a pulverized fuel into a blast furnace which method may sufficiently improve the combustion rate of the pulverized fuel even when a hot blast air having a low temperature of less than 1050° C. is used.

According to one aspect of the present invention, there is provided a method of injecting a pulverized fuel into a blast furnace, comprising the steps of supplying hot blast air having a temperature of at least 810° C. into the blast furnace, injecting the pulverized fuel into the hot blast air, and injecting gas fuel into said hot blast air independently of injection of the pulverized fuel, the gas fuel being supplied to an outer peripheral area of the pulverized fuel.

According to another aspect of the present invention, there is provided a method of injecting pulverized fuel into a blast furnace, comprising the steps of supplying hot blast air having a temperature of at least 810° C. into the blast furnace, injecting the pulverized fuel into the hot blast air, and injecting a a gas fuel into said hot blast air independently of injection of the pulverized fuel, the gas fuel being supplied to an outer peripheral area of the pulverized fuel, wherein an injection amount of the gas fuel is in a proportion of at least 2% of an injection amount of the pulverized fuel in terms of a calorific value.

A more complete appreciation of the invention and many of the attendant advantages thereof will be readily obtained as the same becomes better understood by reference to the following detailed description when considered in connection with the accompanying drawings, wherein:

DESCRIPTION OF THE PREFERRED EMBODIMENTS

Figure 1:
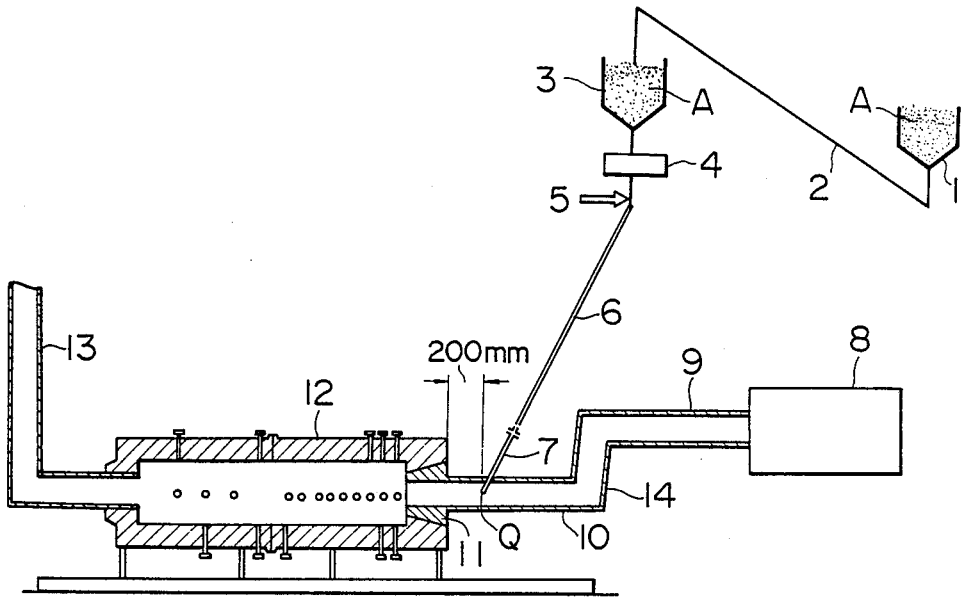
FIG. 1 is a schematic illustration of a combustion apparatus used in the experiment according to the present invention.

Referring to FIG. 1, there is schematically shown a combustion apparatus used in a combustion test, which apparatus is designed to have a structure similar to an actual tuyere section of a blast furnace. Pulverized fuel A is transferred from a ground hopper 1 to a coal-bin 3 by means of a screw conveyor 2. The coal-bin 3 is provided at its lower portion with a pulverized fuel feeder 4 to feed a metered amount of the pulverized fuel A to a burner 7 through a feed pipe 6 via air currents 5. On the other hand, hot blast air produced by a hot blast stove 8 is fed from an air feed pipe 9 through a blow pipe 10 and a water-cooled tuyere 11 to an experimental combustion furnace 12. Reference numeral 13 designates a stack.

As the fuel injection section of the blast furnace consisting of the blow pipe 10 and the water-cooled tuyere 11 is quite different from a known combustion apparatus, the illustrated experimental apparatus is approximated to an actual injection section of the blast furnace. Further, the test furnace is provided with a plurality of peep windows for observation of the condition of combustion and ignition of the pulverized fuel, and with an inspection hole for measurement of furnace temperature, furnace gas temperature, furnace dust and flame radiation quantity, etc. In addition, a peep window 14 is provided at a bent portion at the upstream end of the blow pipe 10 for observing the deposition of ashes on an inner wall of the blow pipe 10.

The foregoing apparatus was used in a series of tests hereinafter described, which were conducted under the following conditions.

Test conditions:

Pulverized Fuel: Coal, containing 35 wt. % of volatile matter

Fuel injection rate: 100 kg/hr

Hot blast air temperature: 700°–1200° C.

Fuel injecting position: Point Q, 200 mm upstream of the boundary between the tuyere and the blow pipe First, the inventors examined the reason why the combustion rate was no sufficiently improved at a temperature lower than 1050° C. by following the method as disclosed in the aforementioned published specification and they have found the following fact. That is, the pulverized fuel injected from the burner 7 into the blow pipe 10 receives heat from the hot blast air flowing in the blow pipe 10 to volatize the volatile matter (hydrogen or carbon monoxide), which in turn reaches its ignition temperature to start combustion. However, in the case where the hot blast air temperature is too low in the aforementioned conventional method, a considerable amount of calories result from the mixed phase flow of carrier gas and pulverized fuel, causing insufficient heating of the pulverized fuel. As a result, the volatile matter is delayed in starting volatilization, and the volatilization speed becomes low. Furthermore, a volatilized gas is delayed in reaching an ignition temperature. Thus, considerable time is required from the injection of the pulverized fuel to the ignition of the volatile matter. As a result, ignition of the pulverized fuel occurs at the end of the tuyere or in a race way, and accordingly, the combustion time until the pulverized fuel leaves the race way after ignition is relatively greatly shortened. Even when the injection position of the pulverized fuel is shifted to the upstream side by a distance of about 100–350 mm as described in the aforementioned published specification, the combustion time in the race way cannot be substantially extended at the hot blast air temperature lower than 1050° C. After all, the combustion condition of the pulverized fuel at the end of the race way nearly cannot be improved. In particular, the combustion time for passing the pulverized fuel through the race way in the blast furnace operation is greatly shortened as compared with the combustion time for a boiler, kiln, sintering furnace or the like (The former is in a ratio of about 1/300–1/500 of the latter). Under the condition above mentioned, almost half the total residense time is consumed for "preheating" including volatilization and ignition of the volatile matter, and a substantial combustion time tends to be lacking, resulting in a reduced combustion rate.

The present inventors have considered that it is effective to greatly shorten the requisite time until the pulverized fuel injected into the blow pipe is ignited, so as to satisfactorily increase the combustion rate of the pulverized fuel even in using hot blast air having a relatively low temperature. As a result of research along this line of thinking, they have considered that it is effective to inject a combustible gas together with the pulverized fuel into the blow pipe to thereby accelerate rapid volatilization and ignition of the volatile matter in the pulverized fuel by combustion heat of the combustible gas. In the course of advanced research, it has been concluded that the combustible gas is selected from coke oven gas, natural gas, town gas, converter gas, petroleum gas, blast furnace gas or the like, and that such gas fuel is independently injected to an outer peripheral area of the pulverized fuel for rapid ignition using a small amount of the gas, so as to realize the above idea and achieve an actually practical techique. Coke oven gas is preferably employed for the gas fuel since it has a high combustion speed and can be obtained as a by-product in an ironworks plant.

The coke oven gas contains hydrogen (50–60% of a total amount) as a major component, and has a combustion speed 7–8 times that of LPG and natural gas. Accordingly, when the coke oven gas is injected into the blow pipe, it is quickly ignited and burned even in using a hot blast air having a relatively low temperature. The combustion heat of the coke oven gas acts to accelerate rapid volatilization and ignition of the volatile matter in the pulverized fuel, thereby remarkably shortening the requisite time until ignition of the pulverized fuel and resultantly lengthening the combustion time of the pulverized fuel to thereby greatly increase the combustion rate. On the other hand, it is of significance that the gas fuel is used as a carrier gas for feeding the pulverized fuel, and is supplied together with the pulverized fuel. However, the present inventors have found that the gas fuel should be supplied independently of the pulverized fuel for the following reasons. That is, in the event that a mixture of the gas fuel and the pulverized fuel is supplied into the blow pipe, the temperature rise and ignition of the gas fuel by the hot blast air is suppressed by the mixing of the pulverized fuel, and a satisfactory combustion accelerating effect cannot be obtained. More particularly, it is generally considered that the reduced amount of carried gas having a low temperature is preferable when injecting the pulverized fuel into the blast furnace. A ratio in weight of the pulverized fuel to the carrier gas is generally selected from the range of 10–30 (kg/kg). Under the injection condition where the pulverized fuel have a high spatial particle density in the gas fuel as mentioned above, the radiation transfer efficiency and an optical transmission in the solid/gas dual phase flow as injected become unavoidably low. Moreover, if adopting the method of supplying the mixture of the gas fuel and the pulverized fuel, the gas fuel is diluted by a large amount of the pulverized fuel. While the solid/gas mixed phase flow proceeds to the ignited and burned at its outermost periphery by the heat of the hot blast air, it is required to raise the temperature of the pulverized fuel simultaneously with a rise in temperature up to an ignition temperature of the gas fuel (i.e. the pulverized fuel has a heat capacity greater than that of the gas fuel). Thus, the ignition and combustion itself of the gas fuel are delayed in connection with the delay of ignition due to dilution by the pulverized fuel, and it is therefore impossible to satisfactorily enhance the combustion accelerating effect. Further, it is needless to say preferable to supply the gas fuel independently of the pulverized fuel from the standpoint of independent control of the flow rates of both the fuels, and in addition, safety may be assured.

Figure 2:
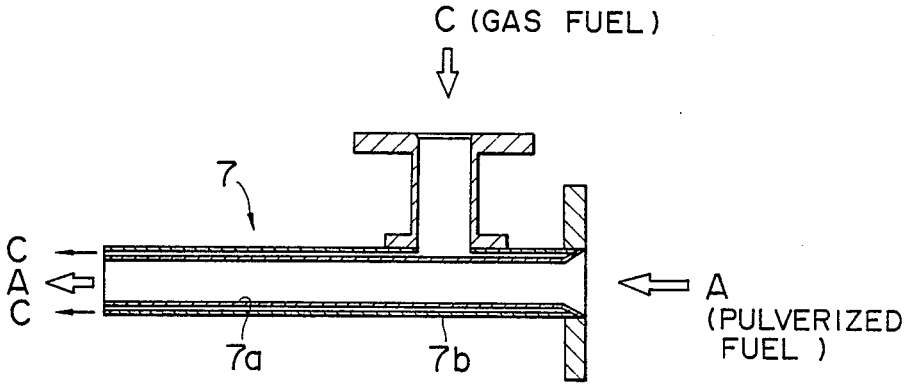
FIG. 2 is a partially sectional side view of a burner having a multiple pipe structure as used in a preferred embodiment of the present invention.

When the gas fuel is independently supplied to an outer peripheral area of the pulverized fuel according to the present invention, the gas fuel instantaneously rises in temperature up to its ignition temperaure upon contact with the hot blast air, and thereby it is ignited and burned. The combustion heat of the gas fuel is effectively utilized for volatilization and ignition of the volatile matter in the pulverized fuel, thereby remarkably shortening the time required until the start of combustion of the pulverized fuel. Thus, the effect of the present invention may be exhibited by supplying the gas fuel independently of the pulverized fuel. Most preferably, the pulverized fuel injection nozzle 7 as shown in FIG. 2 (vertical sectional view) has a multiple pipe structure (e.g. a double pipe structure in this embodiment) constructed by an inner pipe *7a* for supplying the pulverized fuel A therethrough and an outer pipe *7b* for supplying the gas fuel C therethrough. According to this structure, the gas fuel C is injected in such a manner as to surround the pulverized fuel A. Therefore, the gas fuel C at the outermost periphery of the pipe structure is quickly ignited and burned by the hot blast air, and the pulverized fuel is heated entirely from the outer peripheral area by the combustion heat of the gas fuel, thus remarkably shortening the time until start of ignition and combustion of the pulverized fuel.

The outer pipe *7b* of the nozzle 7 has a plurality of separate injection outlets for injecting the gas fuel into the hot blast air. Alternatively, the outer pipe *7b* of the nozzle 7 has an annular injection outlet for injecting the gas fuel into the hot blast air.

Figure 3:
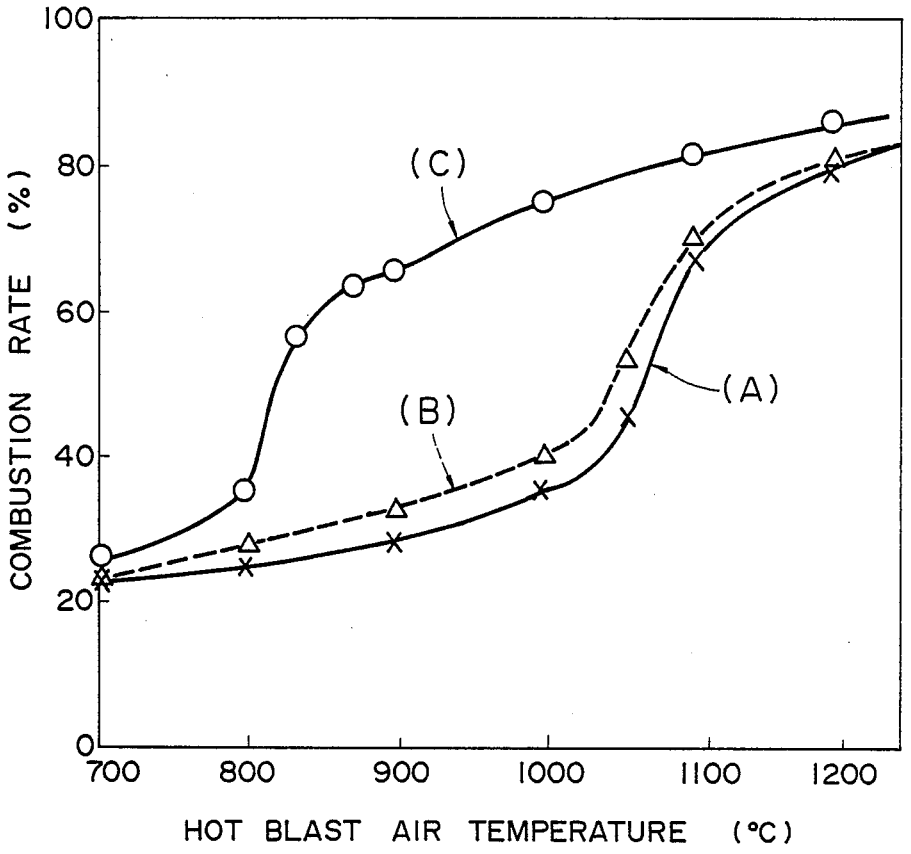
FIG. 3 is a graph showing an improved combustion rate according to one aspect of the present invention.

In order to exhibit a satisfactory combustion accelerating effect as obtained by injecting the gas fuel, it is required for the hot blast air to have a lower temperature limit for igniting the gas fuel. As will be apparent from the following test (See FIG. 3), the lower teperature limit of the hot blast air must be at least 810° C. If the temperature of the hot blast air is lower than 810° C., a considerable time period for ignition only of the gas fuel is required, and a combustion accelerating effect beyond the prior art (not employing a gas fuel to be injected) cannot be obtained. FIG. 3 shows the relation between hot blast air temperature and combustion rate in the following cases by using the experimental combustion apparatus as shown in FIG. 1.

(A) Pulverized fuel only was injected.

(B) Coke oven gas of 10N $m^3$/H was mixed with the fuel feeding air 5, and was supplied with the pulverized fuel.

(C) The pulverized fuel injection burner 7 of a double pipe structure as shown in FIG. 2 was used to independently supply the pulverized fuel through the inner pipe *7a* and the coke oven gas (10N $m^3$/H) through the outer pipe *7b*.

As will be appreciated from the result shown in FIG. 3, the following may be conceived.

(1) According to the case (A) as disclosed in the aforementioned published specification, the combustion rate is improved by increasing the hot blast air temperature beyond 1050° C., but is cannot be anticipated to satisfactorily improve the combustion rate insofar as the hot blast air having a temperature lower than 1050° C. is employed.

(2) In the case (B) where the coke oven gas is supplied with the pulverized fuel, but both fuels are supplied in a mixed condition, the combustion rate is improved slightly more than that in the case (A), but a remarkable effect cannot be obtained.

(3) In the case (C) according to the present invention employing the double pipe structure nozzle having an inner pipe for supplying the pulverized fuel and an outer pipe for supplying a coke oven gas, the combustion rate is rapidly increased at temperatures higher than about 810° C., and especially in the range of 810°–1050° C., the combustion rate is increased two to three times that of the prior art.

Further, in the case of using a liquid fuel such as tar and heavy oil instead of the pulverized fuel, the liquid fuel is stored in a heating tank (not shown), and is pumped up to be supplied to the burner 7, for example.

As will be understood from the above description, an injection amount of the gas fuel is such that a sufficient amount of calories should be generated by the gas fuel so as to accelerate volatilization and ignition of the burning resistant fuel including the pulverized fuel and the liquid fuel such as tar and very heavy oil.

Figure 4:
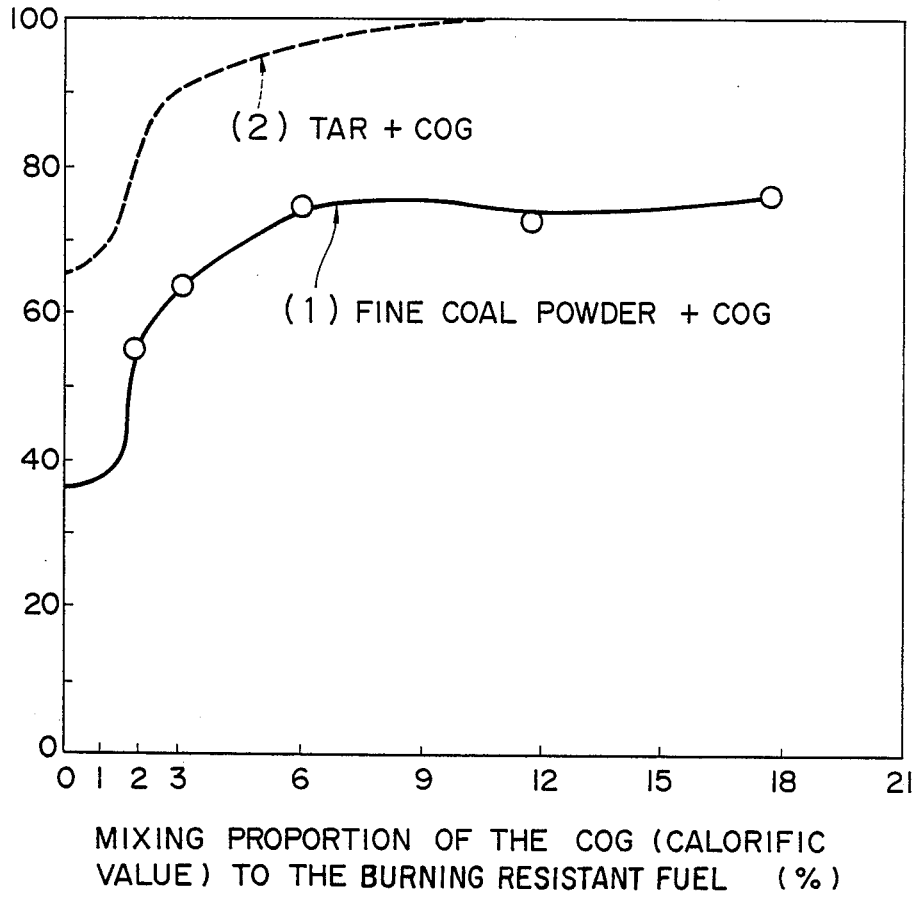
FIG. 4 is a graph showing an improved combustion rate according to another aspect of the present invention.

FIG. 4 shows an improved combustion rate according to the present invention as a result of tests using pulverized coal and tar as a typical example of the burning resistant fuel, which tests are conducted with the use of the experimental combustion apparatus as shown in FIG. 1. Naturally, also in using coke and very heavy oil as the burning resistant fuel, similar results may be obtained.

The tests were conducted under the following conditions:

Test conditions:

burning resistant fuel:

1. Pulverized coal (containing 35 wt. % of volatile matter)
2. Tar

Fuel injection rate: $75\times10^4$ kcal/hr (constant)

Hot blast air temperature: 1000° C.

Fuel injecting position: Point Q, 200 mm upstream of the boundary between the tuyere and the blow pipe The graphs (1) and (2) shown in FIG. 4 were obtained by conducting the following tests.

(1) The pulverized fuel injection burner 7 of a double pipe structure as shown in FIG. 2 was used to independently inject the pulverized coal through the inner pipe *7a* and the coke oven gas (COG) through the outer pipe *7b*.

(2) The burner having a double pipe structure as shown in FIG. 2 (which is more slender than the above-mentioned burner 7) was used to independently inject the tar through the inner pipe *7a* and the coke oven gas (COG) through the outer pipe *7b*.

The abscissa in FIG. 4 denotes an injection amount of the coke oven gas (COG), that is, the proportion of calories of the coke oven gas to calories of the pulverized coal or the tar. A zero point of the injection amount of the pulverized coal or the tar means that pulverized coal or tar is solely injected. The ordinate denotes a total combustion rate at a distance of 0.4 m from the end of the tuyere. When the injection amount of the pulverized coal or the tar is maintained at a constant value of $75\times10^4$ kcal/hr, and the injection amount of the coke oven gas is increased, the combustion rate is gradually increased to reach about 75% for pulverized coal injection, while reaching 100% (complete combustion) for tar injection.

The combustion rate is improved about 15% when the mixing proportion of the coke oven gas to the burning resistant fuel such as the pulverized coal or the tar is set at 2% in terms of a calorific value. In other words, since the combustion rate in the race way may be improved, the discharge force of the incombustible component to the outside of the race way is reduced to thereby permit a large amount of fuel to be injected. As is apparent from the graphs, the combustion rate of the pulverized coal is saturated at about 75% because of the fact that a remaining rate of 25% depends on combustion of char having a low combustion speed. As is apparent from FIG. 4, it is necessary to inject the gas fuel in a proportion of at least 2% to an injection amount of the burning resistant fuel in terms of a calorific value, so as to accelerate volatilization and ignition of the burning resistant fuel and satisfactorily exhibit the combustion accelerating effect. It is preferable to set the injection amount of the coke oven gas within the range of 2–10%, so as to reduce the injection amount of the coke oven gas as little as possible and exhibit the combustion accelerating effect.

While the combustion accelerating effect as mentioned above was also observed when using natural gas, town gas, petroluem gas, converter gas and blast furnace gas, the improvement in the combustion rate with the gas injection amount maintained constant was remarkable in case of using the coke oven gas.

The effect of the present invention as described above may be summarized as follows:

(1) The combustion rate of the pulverized fuel may be satisfactorily increased even when a hot blast air temperature is low, thereby permitting a large amount of the pulverized fuel to be injected to greatly reduce a fuel cost. Further, even when a high temperature of the hot blast air is difficult to obtain, the pulverized fuel may be effectively utilized.

(2) The blast furnace operation may be carried out with the hot blast air temperature positively reduced, thereby saving energy and suppressing deterioration of a refractory including a duct or the like.

(3) As the combustion rate may be sufficiently increased, an increased proportion of inexpensive coal may be used to thereby reduce fuel costs.

(4) As the combustion rate is stable at a high level, the stability of the operating condition of the blast furnace may be also increased to thereby improve a blast furnace operation efficiency.

(5) The only additional necessary equipment for embodying the present invention is a burner having a multiple pipe structure or an alternative gas fuel injecting device, such that increased costs can be suppressed.

(6) The coke oven gas which is the most suitable for a gas fuel, having the highest combustion speed, is available at low cost since it is produced as an indispensable raw material in coke producing equipment, which is generally located adjacent a blast furnace.

(7) As the solid fuel is injected independently of the gas fuel, the flow rate of each fuel may be easily controlled.

(8) As the gas fuel acts as a cooling gas, the life of the burner may be lengthened.

While the invention has been described with reference to specific embodiments, the description is merely illustrative and is not to be construed as limiting the scope of the invention. Various modifications and changes may occur to those skilled in the art without departing from the spirit and scope of the invention as defined by the appended claims.

What is claimed is:

1. A method of injecting a burning resistant fuel into a blast furnace, which comprises:

supplying a hot blast air having a temperature of 810°-1050° C. into said blast furnace;

injecting said burning resistant fuel into said hot blast air; and injecting a gas fuel into said hot blast air independently of injection of said burning resistant fuel, said gas fuel being supplied to an outer peripheral area of said burning resistant fuel so as to surround said burning resistant fuel and such that said burning resistant fuel is heated entirely from said outer peripheral area by combustion heat of said gas fuel wherein an injection amount of said gas fuel is in a proportion of at least 2% of an injection amount of the burning resistant fuel in terms of calorific value.

2. The method according to claim 1, further comprising supplying said burning resistant fuel via a multi-pipe burner having a center pipe and supplying said gas fuel via an outer annular portion of said burner.

3. The method according to claim 1, further comprising supplying said burning resistant fuel via a multi-pipe burner having a center pipe and supplying said gas fuel via an outer annular portion of said burner.

4. The method according to claim 2, wherein said outer annular portion of said multi-pipe burner has a plurality of separate injection outlets and which further comprises injecting said gas fuel into said hot blast air via said outlets.

5. The method according to claim 3, wherein said outer annular portion of said multi-pipe burner has a plurality of separate injection outlets and which further comprises injecting said gas fuel into said hot blast air via said outlets.

6. The method according to claim 2, wherein said outer annular portion of said multi-pipe burner has an injection outlet and which further comprises injecting said gas fuel into said hot blast air via said outlets.

7. The method according to claim 3, wherein said outer annular portion of said multi-piped burner has an annular injection outlet for injecting said gas fuel into said hot blast air.

8. The method according to claim 1, wherein said burning resistant fuel comprises pulverized coal.

9. The method according to claim 1, wherein said gas fuel comprises coke oven gas.

10. The method according to claim 1, wherein said gas fuel comprises natural gas.

11. The method according to claim 1, which further comprises using a blow pipe connected between a tuyere of said blast furnace and a source of said hot blast air, and injecting said pulverized fuel and said gas fuel into said blow pipe.

12. The method according to claim 1, wherein said burning resistant fuel is selected from the group consisting of a pulverized fuel, coke, tar, and very heavy oil.

13. The method according to claim 1, wherein said gas fuel is selected from the group consisting of town gas, converter gas, petroleum gas and blast furnace gas.

* * * * *